US007723653B2

(12) United States Patent
Clark et al.

(10) Patent No.: US 7,723,653 B2
(45) **Date of Patent: *May 25, 2010**

(54) METHOD FOR TEMPERATURE CYCLING WITH INDUCTIVE HEATING

(75) Inventors: Kyle B. Clark, Underhill, VT (US); Stefan von Buren, Colchester, VT (US)

(73) Assignee: iTherm Technologies, LP, Merrimack, NH (US)

( * ) Notice: Subject to any disclaimer, the term of this patent is extended or adjusted under 35 U.S.C. 154(b) by 393 days.

This patent is subject to a terminal disclaimer.

(21) Appl. No.: 11/505,032

(22) Filed: Aug. 16, 2006

(65) Prior Publication Data

US 2008/0053986 A1 Mar. 6, 2008

(51) Int. Cl.
*H05B 6/38* (2006.01)

(52) U.S. Cl. ..... 219/644; 219/635; 164/113

(58) Field of Classification Search ..... 219/635, 219/644, 643, 667; 425/174–175; 264/403, 264/472, 486; 164/113, 312–318, 900
See application file for complete search history.

(56) References Cited

U.S. PATENT DOCUMENTS

| | | | | |
|---|---|---|---|---|
| 1,852,215 | A | 4/1932 | Northrup | |
| 2,829,227 | A | 4/1958 | Antonis | |
| 2,875,311 | A | 2/1959 | Harkenrider | |
| 2,947,045 | A | 8/1960 | Goldhamer | |
| 3,376,403 | A | 4/1968 | Mircea | |
| 3,536,983 | A | 10/1970 | Kennedy | |
| 3,620,294 | A * | 11/1971 | Hetzel et al. | 164/155.4 |

(Continued)

FOREIGN PATENT DOCUMENTS

DE 965761 C 6/1957

(Continued)

OTHER PUBLICATIONS

International Search Report and Written Opinion mailed Dec. 20, 2007 in a related application Serial No. PCT/US2007/018125 (U.S. Appl. No. 11/505,059).

(Continued)

*Primary Examiner*—Quang T Van
(74) *Attorney, Agent, or Firm*—Rissman Hendricks & Oliverio, LLP

(57) ABSTRACT

Apparatus and method for inductive heating of a material located in a channel, to modify the state of the material between flowable and nonflowable states. An internal inductive heating assembly is disposed in the material in the channel, and a signal is supplied to the assembly to generate a magnetic flux in at least one of the assembly and the material, the magnetic flux generating inductive heating of the assembly and/or the material. The signal is adjusted to produce a desired rate of temperature cycling of the material in the channel which includes modifying the state of the material between flowable and nonflowable states. In one embodiment, the heating assembly includes an interior coil, an exterior sheath inductively coupled to the coil, a dielectric material disposed between the coil and sheath, a flux concentrator, and a conductor for supplying a signal to the coil to generate the magnetic flux. The materials and/or Curie temperatures of the coil, sheath and/or flux concentrator may be selected to provide a desired rate of inductive heating of the sheath and/or the material.

20 Claims, 5 Drawing Sheets

U.S. PATENT DOCUMENTS

| | | | | |
|---|---|---|---|---|
| 4,704,509 | A | 11/1987 | Hilmersson et al. | |
| 5,012,487 | A | 4/1991 | Simcock | |
| 5,101,086 | A | 3/1992 | Dion | |
| 5,385,200 | A * | 1/1995 | Yuki et al. | 164/457 |
| 5,713,069 | A | 1/1998 | Kato | |
| 5,902,509 | A | 5/1999 | Bruckner et al. | |
| 6,011,245 | A | 1/2000 | Bell | |
| 6,084,225 | A | 7/2000 | Schmitt | |
| 6,460,596 | B1 | 10/2002 | Yamaguchi et al. | |
| 6,546,039 | B2 | 4/2003 | Fishman | |
| 6,580,896 | B2 | 6/2003 | Lee | |
| 6,798,822 | B2 | 9/2004 | Fishman et al. | |
| 6,849,342 | B1 | 2/2005 | Czerwinski et al. | |
| 7,034,263 | B2 | 4/2006 | Kagan | |
| 7,034,264 | B2 | 4/2006 | Kagan | |
| 7,049,562 | B2 | 5/2006 | Tanino et al. | |
| RE39,291 | E | 9/2006 | Kestle et al. | |
| 7,140,873 | B1 | 11/2006 | House | |
| 2002/0189781 | A1 | 12/2002 | Shibata et al. | |
| 2003/0057201 | A1 | 3/2003 | Johnson | |
| 2003/0067376 | A1 | 4/2003 | Maenosoni | |
| 2003/0132224 | A1 | 7/2003 | Spencer | |
| 2004/0028111 | A1 | 2/2004 | Fishman et al. | |
| 2004/0084171 | A1 * | 5/2004 | Akers et al. | 164/113 |
| 2005/0191098 | A1 | 9/2005 | Ueno et al. | |
| 2006/0076338 | A1 | 4/2006 | Kagan | |
| 2006/0093413 | A1 | 5/2006 | Matsumoto | |

FOREIGN PATENT DOCUMENTS

| | | | | |
|---|---|---|---|---|
| DE | 3118030 | A1 | 12/1982 | |
| DE | 102005021238 | A1 | 11/2006 | |
| EP | 0403138 | A | 12/1990 | |
| GB | 508255 | A | 6/1939 | |
| JP | 1-170547 | | 7/1989 | |
| JP | 1-313134 | * | 12/1989 | 164/900 |
| JP | 2004-108666 | A | 4/2004 | |
| JP | 2005-259558 | A | 9/2005 | |

OTHER PUBLICATIONS

International Search Report and Written Opinion mailed Mar. 26, 2008 in a related application Serial No. PCT/US2007/018041 (U.S. Appl. No. 11/505,023).

International Search Report and Written Opinion mailed Apr. 24, 2008 in a related application Serial No. PCT/US2007/018171 (U.S. Appl. No. 11/505,022).

International Search Report and Written Opinion mailed Dec. 28, 2007 in corresponding application Serial No. PCT/US2007/018113.

Office Action dated Jul. 11, 2008 under U.S. Appl. No. 11/505,022.

* cited by examiner

METHOD FOR TEMPERATURE CYCLING WITH INDUCTIVE HEATING

FIELD OF THE INVENTION

This invention relates to an apparatus and method for inductive heating of a material located in a channel, wherein an internal inductive heating assembly is provided in the material in the channel for producing a desired rate of temperature cycling of the material between flowable and nonflowable states

BACKGROUND OF THE INVENTION

It is common practice to inductively heat an article (e.g., a solid cylinder or hollow tube) of a magnetizable material, such as steel, by inducing an eddy current in the article. This eddy current is induced by an applied magnetic flux generated by passage of an alternating current through a heater coil wound around the article. The heat inductively generated in the article may then be transmitted to another article, e.g., a metal or polymer material flowing through a bore or channel of an inductively heated steel tube.

Various systems have been proposed which utilize different combinations of materials, structural heating elements, resonant frequencies, etc., for such heating techniques. There is an ongoing need for an apparatus and method for heating a material in a channel which provides one or more of higher power density, tighter temperature control, reduced power consumption, longer operating life, and/or lower manufacturing costs.

SUMMARY OF THE INVENTION

In accordance with one embodiment of the invention, a method is provided for temperature cycling a material located in a channel to modify the state of the material between flowable and nonflowable states. The method includes steps of providing an internal inductive heating assembly in the material in the channel, and supplying a signal to the assembly to generate a magnetic flux in at least one of the assembly and the material, the magnetic flux generating inductive heating of the assembly and/or the material. The signal is adjusted to produce a desired rate of temperature cycling of the material in the channel which includes modifying the state of the material between flowable and nonflowable states.

The nonflowable state may be one or more of a physically rigid and a semi-rigid state. The flowable state may be one or more of a semi-solid and a liquid state.

In one embodiment, the heating assembly includes an exterior sheath disposed in contact with the material and an interior coil inductively coupled to the sheath. The signal is supplied to the coil to generate the magnetic flux in one or both of the sheath and the material. The heating assembly may further include a flux concentrator to increase the inductive coupling between the coil and the sheath. The coil and sheath may be in thermal communication to allow transmission of heat from the coil to the sheath.

In one embodiment, the channel is provided in an outer element, and the temperature cycling includes cooling of the material by conductive transfer of heat from the material to the outer element.

The material may be one or more of an electrically conductive, ferromagnetic, electrically nonconductive, thermally insulating and thermally conductive material. The material may be one or more of a metal and a polymer.

The coil and sheath may be configured to minimize the resistive heating of the coil, in order to maintain the coil temperature within operating limits. The coil and sheath may be in thermal communication enabling transmission of heat from the coil to the sheath.

The signal may comprise current pulses providing high frequency harmonics in the coil. This signal is particularly useful in systems having a high damping coefficient which are difficult to drive (inductively) with sustained resonance.

In various embodiments, the method may further include selecting the Curie temperature(s) of one or more of the coil and the sheath to provide a desired rate of inductive heating of the sheath and/or the material. The Curie temperature of the flux concentrator may also be selected for this purpose.

In other embodiments, the method includes the step of providing one or more materials for the coil, dielectric, sheath, and/or flux concentrator to achieve a desired operating temperature and/or rate of inductive heating of the assembly component and/or material.

In one embodiment, the channel is provided in a melt distribution system, such as a manifold, including one or more channels feeding one or more gates. Where multiple gates are fed, the temperature cycling may be performed in parallel for the multiple gates.

In accordance with another embodiment of the invention, an inductive heating assembly is provided comprising:

an interior coil;

an exterior sheath inductively coupled to the coil;

a dielectric material disposed between the coil and sheath; and a conductor for supplying a signal to the coil to generate a magnetic flux for inductive heating of the sheath, and wherein the Curie temperature of the coil is below an operating temperature of the material and the Curie temperature of the sheath is above the operating temperature of the material. The assembly may further include a flux concentrator; the Curie temperature of the flux concentrator is also above the operating temperature of the flux concentrator.

These and other features and/or advantages of several embodiments of the invention may be better understood by referring to the following detailed description in conjunction with the accompanying drawings.

DETAILED DESCRIPTION

In accordance with various embodiments of the invention, an inductive heating apparatus is used for temperature cycling of a material located in a channel. The material may be cycled between a nonflowable and a flowable state.

Figure 3:
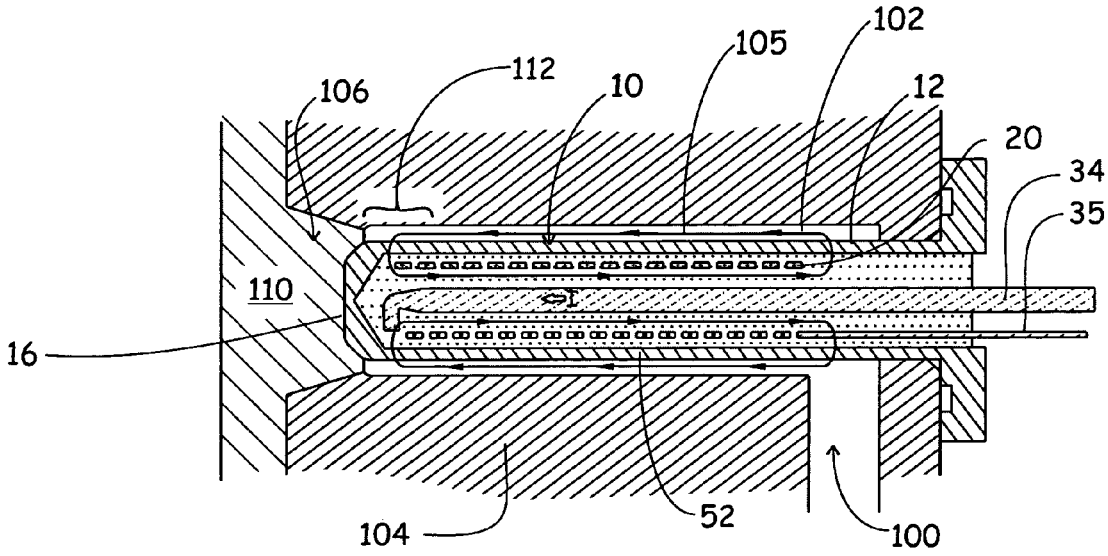
FIG. 3 is a schematic cross-sectional view of a probe heater similar to that shown in FIG. 1, disposed at the gate end of an injection molding system, illustrating use of a probe heater to melt a plug formed adjacent the gate area.
Figure 4:
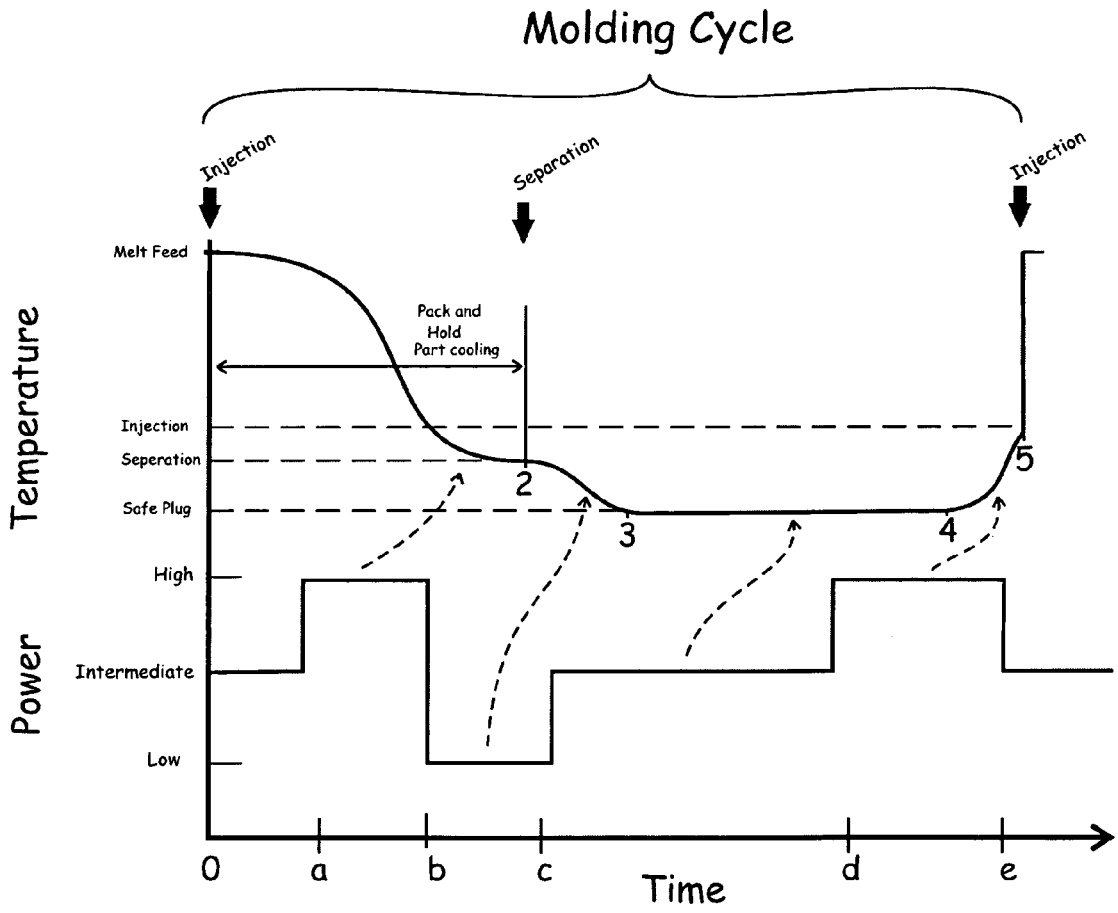
FIG. 4 shows a power and temperature profile (over time) for a particular molding cycle, illustrating one embodiment of the invention.
Figure 5:
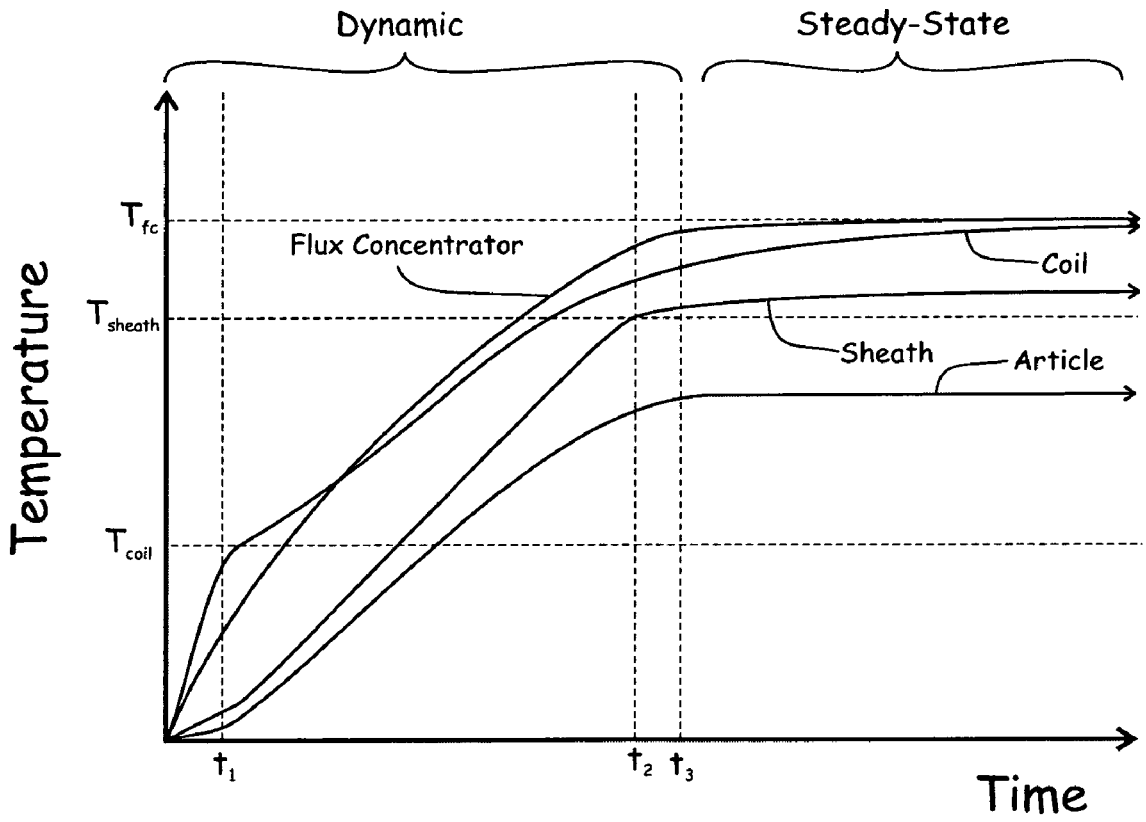
FIG. 5 is a temperature profile (with respect to time) showing the dynamic heating rates and steady state temperatures of the respective coil, sheath and flux concentrator of one embodiment of the heater assembly, and that of the material being heated.

FIGS. 4-5 illustrate certain applications of the present invention. Before discussing these applications, a suitable inductive heating assembly and its use in heating a material located in a channel will be described with respect to in FIGS. 1-3.

Figure 1:
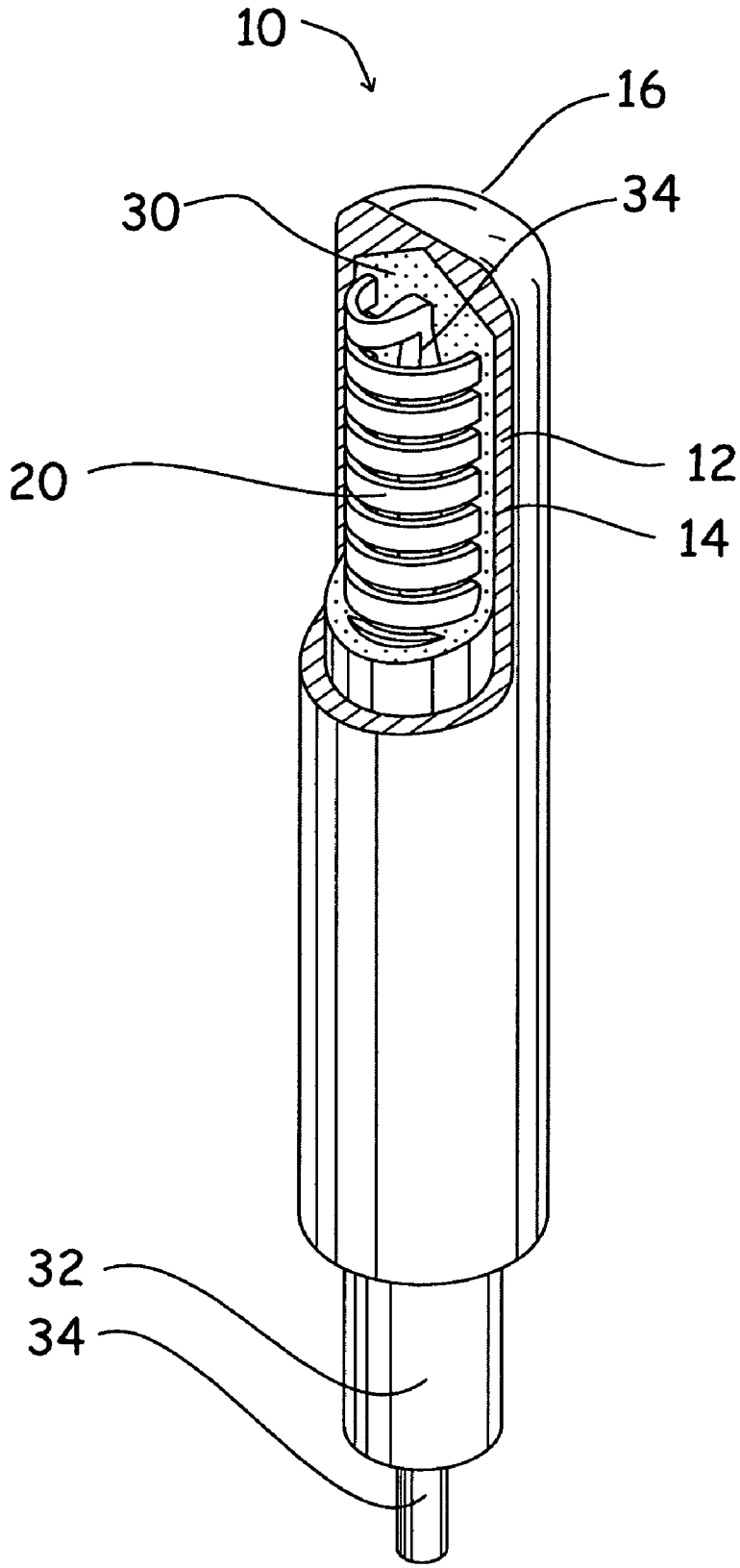
FIG. 1 is a schematic view of a probe heater according to one embodiment of the invention, including a partial cut-away view showing the interior inductive coil and dielectric insulation inside the outer ferromagnetic sheath.

A first embodiment of an inductive heating assembly is illustrated in FIG. 1, herein referred to as a probe heater 10. The heater 10 has a generally elongated profile and is adapted to be disposed in a channel (see FIG. 3) for heating of a material in the channel. The heating assembly includes a generally cylindrical exterior ferromagnetic sheath 12 having a hollow interior 14 and being closed at one end 16. Within the hollow interior of the sheath is a heating element or inductor coil 20, here provided as a substantially helical coil extending along an axial length of the sheath. Dielectric insulation 30 is provided in and around the coil, including between the individual turns of the coil, for electrically isolating the coil 20 from the sheath 12. The coil has coaxial power leads, including an outer cylindrical lead 32 connecting to one end of the coil, and a central axial lead 34 connecting to the other end of the coil and extending along the cylindrical axis of the coil/assembly.

Figure 2:
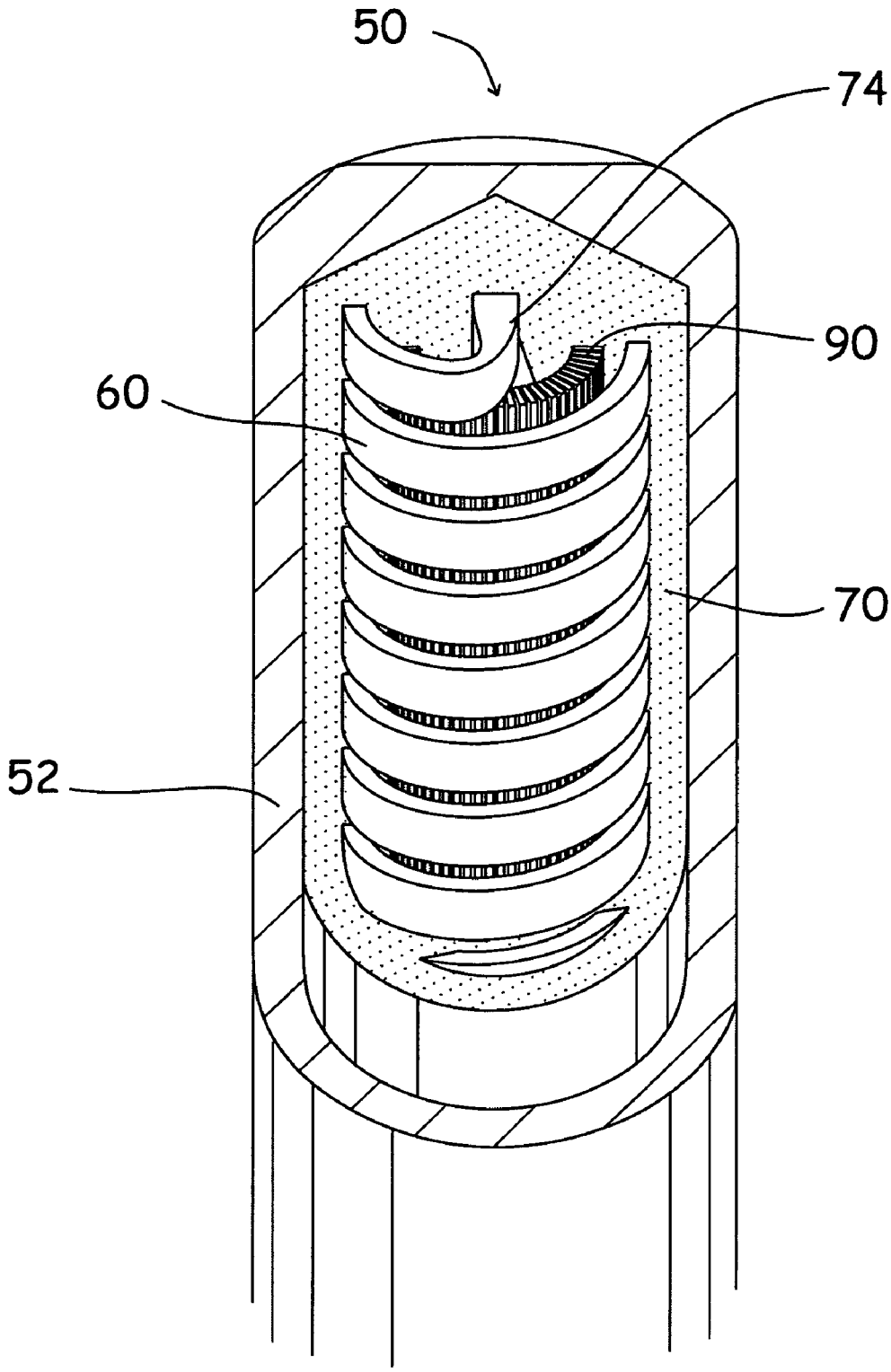
FIG. 2 is an expanded, partial cut-away view of another embodiment of a probe heater according to one embodiment of the invention, further including a flux concentrator disposed radially interior to the inductor coil.

FIG. 2 illustrates a second embodiment of a heater probe 50 which is similar to the first embodiment but further includes a ferromagnetic flux concentrator for closing the magnetic loop with the outer sheath. Similar to FIG. 1, the heating assembly of FIG. 2 includes an outer ferromagnetic sheath 52, a coiled heating element 60, dielectric insulation 70, and concentric power leads (return lead 74 is shown). The assembly further includes a substantially cylindrical flux concentrator 90 concentrically disposed within the coil 60 and extending axially along a length of the heating assembly. This high permeability flux concentrator enhances the magnetic field by forming a closed magnetic loop with the exterior sheath 52, thus increasing the magnetic coupling between the coil 60 and sheath 52. The flux concentrator preferably has an open current loop (e.g., slotted as shown) to reduce the eddy currents (and thus heat) generated in the flux concentrator.

FIG. 3 illustrates one application of the heating assembly of FIG. 1 disposed in a channel 102 (a tubular passage or conduit for a flowable material), the channel being located in an outer element 104. The outer element 104 may be, for example, a mold insert, a hotrunner manifold or a nozzle, having a melt channel 102 through which a flowable material 100, such as a conductive liquid metal, is adapted to flow. The channel at one end of the outer element has a tapered region or gate area 106, also referred to as a separation area, enabling a molded part 110, formed in the gate area 106 and in an adjacent mold cavity, to be separated from the material remaining in the melt channel 102. The flowable material travels through the channel toward the gate 106 and into the mold cavity, where it is cooled to a nonflowable solid state and forms a molded part 110. In order to provide a clean break at the gate (preferably no drool from the gate), the material in the channel area 112 adjacent to the gate area 106 must be cooled from a flowable (e.g., liquid or semi-solid state) to a nonflowable (e.g., physically rigid or semi-rigid (deformable) state). The nonflowable material which forms and remains in the channel area 112 adjacent to gate 106, is typically referred to as a plug. Formation of a plug thus enables the clean separation of the solidified material in the gate area 106 (the molded part) when the mold is opened (e.g., a mold core is moved away from the opposite side of the mold). Cooling of the material in channel area 112 adjacent the gate region can be accomplished by thermal conduction, e.g. by conduction of heat toward the molded part 110 (which is in contact with the cooler mold core and cavity walls); by providing an additional cooling medium at or near the gate area 106 to draw heat away from the material in channel area 112; and/or by any other process parameter(s) which reduce the temperature of the material in channel area 112.

During a next molding cycle, the nonflowable plug must again be heated to a fluid (flowable) state. For this purpose, an inductive heating assembly (probe heater 10) is positioned in the material in the channel 102, with the closed end 16 of the outer sheath disposed at or near the separation area 106. The probe heater 10 is centrally disposed in the channel 102 and is surrounded by a relatively narrow annular width of open channel area. A plug of material will be formed around the sheath in the area 112 at the gate end of the channel. In order to melt the plug (reduce its viscosity) so that material can again be injected through the gate, a magnetic field (see lines 105) is generated by the interior coil 20 of the probe which is transmitted to one or more of the exterior sheath 52 and the material 100 in the channel for inductive heating of the sheath and/or material respectively. The plug is thus heated and converts back to a fluid state, allowing the material to flow around the exterior sheath and exit through the gate 106.

The probe heater according to the present invention is not limited to specific materials, shapes or configurations of the components thereof. A particular application or environment will determine which materials, shapes and configurations are suitable.

For example, the inductor coil may be one or more of nickel, silver, copper and nickel/copper alloys. A nickel (or high percentage nickel alloy) coil is suitable for higher temperature applications (e.g., 500 to 1,000° C.). A copper (or high percentage copper alloy) coil may be sufficient for lower temperature applications (e.g., <500° C.). The coil may be stainless steel or Inconel (a nickel alloy). In the various embodiments described herein, water cooling of the coil is not required nor desirable.

The power leads supplying the inductor coil may comprise an outer cylindrical supply lead and an inner return lead concentric with the outer cylindrical supply lead. The leads may be copper, nickel, Litz wire or other suitable materials.

The dielectric insulation between the inductor coil and outer ferromagnetic sheath may be a ceramic such as one or more of magnesium oxide, alumina, and mica. The dielectric may be provided as a powder, sheet or a cast body surrounding the coil.

The coil may be cast on a ceramic dielectric core, and a powdered ceramic provided as a dielectric layer between the coil and sheath.

The coil may be cast in a dielectric ceramic body and the assembly then inserted into the sheath.

The sheath may be made from a ferromagnetic metal, such as a series 400 steel or a tool steel.

The flux concentrator may be provided as a tubular element disposed between the coil and the return lead. The flux concentrator may be a solid, laminated and/or slotted element. For low temperature applications, it may be made of a non-electrically conductive ferromagnetic material, such as ferrite. For higher temperature applications it may comprise a soft magnetic alloy (e.g., cobalt).

The coil geometry may take any of various configurations, such as serpentine or helical. The coil cross-section may be flat, round, rectangular or half round. As used herein, coil is not limited to a particular geometry or configuration; a helical wound coil of flat cross section as shown is only one example.

As used herein, heating includes adjusting, controlling and/or maintaining the temperature of a material in a channel.

In a more specific embodiment, given by way of example only and not meant to be limiting, the probe heater may be disposed in a melt channel for heating magnesium. The heater may comprise a tool steel outer sheath, a nickel coil, an alumina dielectric, and a cobalt flux concentrator. The nickel coil, steel sheath and cobalt flux concentrator can all withstand the relatively high melt temperature of magnesium. The nickel coil will generally be operating above its Curie temperature (in order to be above the melt temperature of the magnesium); this will reduce the "skin-effect" resistive heating of the coil (and thus reduce over-heating/burnout of the coil). The steel sheath will generally operate below its Curie temperature so as to be ferromagnetic (inductively heated), and will transfer heat by conduction to raise the temperature of the magnesium in which it is disposed (during heat-up and/or transient operation). The sheath may be above its Curie temperature once the magnesium is melted, e.g., while the magnesium is held in the melt state (e.g., steady state operation or temperature control). The coil will be cooled by conductive transmission to the sheath. Preferably the Curie temperature of the flux concentrator is higher than that of the sheath, in order to maintain the permeability of the flux concentrator, close the magnetic loop, and enhance the inductive heating of the sheath.

Again, the specific materials, sizes, shapes and configurations of the various components will be selected depending upon the particular material to be heated, the cycle time, and other process parameters.

In various applications of the described inductive heating method and apparatus, it may generally be desirable that the various components have the following properties:

- the coil is electrically conductive, can withstand a designated operating temperature, and is paramagnetic at the operating temperature;
- the sheath is ferromagnetic at the desired operating temperature, is thermally conductive, is electrically conductive, and has a relatively uninterrupted path for the eddy current to flow;
- the dielectric material is electrically insulative, thermally conductive, and substantially completely paramagnetic;
- the flux concentrator does not exceed its Curie point during operation, has a high permeability, can withstand high operating temperatures, and has an interrupted (restricted) circumferential path for the eddy current to flow;
- the material is in good thermal contact with the sheath.

In applications where there is direct coupling of the magnetic field to the material, the desired parameters of the sheath are also desired parameters of the material.

The material in the channel to be heated will also effect the selection of the parameters of the assembly components, the applied signal and the heating rates. In various embodiments, the material may include one or more of a metal and a polymer, e.g., a pure metal, a metal alloy, a metal/polymer mixture, etc. In other embodiments the assembly/process may be useful in food processing applications, e.g., where grains and/or animal feed are extruded and cooked.

In various applications, it may be desirable to supply a signal to the coil comprising current pulses having a desired amount of pulse energy in high frequency harmonics for inductive heating of the sheath, as described in Kagan U.S. Pat. Nos. 7,034,263 and 7,034,264, and in Kagan U.S. Patent Application Publication No. 2006/0076338 A1, published Apr. 13, 2006 (U.S. Ser. No. 11/264,780, entitled Method and Apparatus for Providing Harmonic Inductive Power). The current pulses are generally characterized as discrete narrow width pulses, separated by relatively long delays, wherein the pulses contain one or more steeply varying portions (large first derivatives) which provide harmonics of a fundamental (or root) frequency of the current in the coil. Preferably, each pulse comprises as least one steeply varying portion for delivering at least 50% of the pulse energy in the load circuit in high frequency harmonics. For example, the at least one steeply varying portion may have a maximum rate of change of at least five times greater than the maximum rate of change of a sinusoidal signal of the same fundamental frequency and RMS current amplitude. More preferably, each current pulse contains at least two complete oscillation cycles before damping to a level below 10% of an amplitude of a maximum peak in the current pulse. A power supply control apparatus is described in the referenced patents/application which includes a switching device that controls a charging circuit to deliver current pulses in the load circuit so that at least 50% (and more preferably at least 90%) of the energy stored in the charging circuit is delivered to the load circuit. Such current pulses can be used to enhance the rate, intensity and/or power of inductive heating delivered by a heating element and/or enhance the lifetime or reduce the cost in complexity of an inductive heating system. They are particularly useful in driving a relatively highly damped load, e.g., having a damping ratio in the range of 0.01 to 0.2, and more specifically in the range of 0.05 to 0.1, where the damping ratio, denoted by the Greek letter zeta, can be determined by measuring the amplitude of two consecutive current peaks $a_1$, $a_2$ in the following equation:

$$\zeta = \frac{-\ln\left(\frac{a_2}{a_1}\right)}{2\pi}$$

This damping ratio, which alternatively can be determined by measuring the amplitudes of two consecutive voltage peaks, can be used to select a desired current signal function for a particular load. The subject matter of the referenced Kagan patents/application are hereby incorporated by reference in their entirety.

Temperature Cycling

FIG. 4 illustrates one embodiment of an injection molding cycle which may be used for temperature cycling of a plug material formed in a gate area such as that previously described with respect to FIG. 3. FIG. 4 is a graph of temperature and power (on the vertical axis) versus time (on the horizontal axis) wherein:

- the upper portion shows the temperature of the material in the gate area of the manifold system; and
- the lower portion shows the power input to the inductive heating assembly in the gate area of the manifold system.

Generally, a change in the power supplied to the inductive heater assembly anticipates (leads in time) a change in the temperature of the material in the gate area (i.e., there is a time delay between a change in power (the cause) and the desired temperature of the gate material (the effect)). For example, a relatively high level of power is delivered between times (a) and (b) which produces a leveling off (a reduction in the rate of decrease) of the temperature of the material in the gate area at a later time (2). Likewise, a reduction in power to a relatively low level between times (b) and (c), produces a decrease in the gate material temperature between times (2) and (3). Likewise, an increase in power to an intermediate level between times (c) and (d), produces a leveling off of the gate material temperature between times (3) and (4). Finally, an increase to a high power delivery between times (d) and (e), produces an increase in the temperature of the gate material between times (4) and (5).

More specifically, time zero (0) represents the start of an injection cycle in which liquid magnesium is fed at a very high temperature (1) in the range of about 500 620° C. from a manifold to an adjacent mold cavity. At time zero, the input power delivery to the inductive heater (in the gate area of the manifold) is at an intermediate level, selected so that the magnesium remains in the flowable state as it travels through the manifold channel into the mold cavity. Between time (0) and (2), the mold cavity is filled, packed and the part begins to cool in the mold cavity. The relatively cool mold cavity walls act as a heat sink pulling heat out of the material in the mold cavity. At the same time, the close proximity of the manifold to the cooler mold cavity pulls heat away from the gate area of the manifold such that the temperature of the material in the gate area drops from the melt feed temperature at time (0) to a separation temperature at time (2). The separation temperature is within a range that allows separation of the mold cavity from the manifold with a clean break at the gate, i.e., minimum or no drooling extending from the gate region of the molded part. Here, the separation temperature is toward the lower end of a semi-solid temperature range for the magnesium of 450° to 510° F. Further cooling is generally not desirable as it may interfere with obtaining a clean separation.

Following opening (separation) of the mold, the semi-solid material in the gate area at the "separation" temperature is further cooled to a "safe plug" temperature at time (3) to enable a build up of pressure in the manifold for the next cycle. This is accomplished, as previously indicated, by a prior decrease in power delivery to the inductive heater, to a relatively low level between times (b) and (c). This causes a corresponding reduction in temperature of the gate material, between times (2) and (3), when the gate material falls from the separation temperature to the safe plug temperature.

Next, the power supplied to the heater is increased to an intermediate level between times (c) and (d), causing a leveling off of the gate material temperature at the safe plug temperature between times (3) and (4). It is desirable to maintain the gate material at the safe plug temperature, without further cooling, so as to minimize the time/energy required to increase the temperature of the gate material during the next injection cycle.

Before the mold is again closed, the power supplied to the heater is increased to the high level between times (d) and (e), causing a (time delayed) increase in the gate material temperature from the safe plug temperature back up to an injection temperature. Then, at time (5) there is an injection of a new magnesium melt feed at 580-620° C. from the manifold into the mold cavity to begin the next injection cycle. The material in the gate area at time (5) rapidly increases to the melt feed temperature due to replacement by the incoming melt feed at 580-620° C.

Thus, FIG. 4 illustrates one application of a temperature cycling process for heating/cooling a material in a channel between flowable and non-flowable states.

The previously described embodiments of an inductive heating assembly may be used in the process cycle illustrated in FIG. 4. In such a process, the Curie point(s) of the coil, sheath and/or flux concentrator may be selected to achieve a desired dynamic heating rate and steady state temperature profile, such as that illustrated in FIG. 5. Preferably, the Curie temperatures of the flux concentrator and sheath are not exceeded within a desired range of temperature cycling of the material. In FIG. 5, such dynamic heating preferably occurs below $T_{sheath}$ of the sheath, and below $T_{fc}$ of the flux concentrator. In contrast, the Curie point of the coil $T_{coil}$ is selected to be well below the flowable temperature of the material in order to reduce skin effect heating of the coil.

FIG. 5 illustrates the respective heating rates and temperature profiles of the different components of the heater assembly which change over time based on the Curie points of the component materials. In this example, the material in the channel being heated is paramagnetic, so all heating of the material results from thermal conduction from the sheath. Also, the heating rates of the various heater assembly components are interdependent, as there is thermal communication between the coil, flux concentrator, and sheath.

Initially, the coil heats up most rapidly until it reaches its Curie temperature at time $t_1$, at which point the rate of heating of the coil is reduced and ultimately exceeded by the heating rate of the flux concentrator. The flux concentrator remains ferromagnetic (below its Curie temperature $T_{fc}$) during both the dynamic and steady state periods. The flux concentrator is heated both inductively, by the magnetic flux generated in the coil, but also by thermal conduction of heat generated in the coil. Because the flux concentrator is at the center of the assembly, and some of the resistive heat generated in the coil is transmitted outwardly to the sheath, the flux concentrator temperature ultimately exceeds that of the coil. The sheath also is heated both inductively, due to the magnetic flux generated by the coil, and also by thermal conduction of heat from the coil to the sheath. The sheath has a relatively steady heating rate up until its Curie temperature is reached $T_{sheath}$, at time $t_2$, at which point its rate of heating levels off (for steady state operation). The material is heated substantially by thermal conduction from the sheath. Its heating rate follows that of the sheath, with temperatures below that of the sheath.

The "Curie point" or "Curie temperature" of a material is the temperature at which its relative permeability changes from a high value, e.g., greater than about 400, down to 1. The Curie point of some commonly used materials and their alloys are set forth below:

manganese 50° C.

chromium 100° C.

ferrite 200 to 400° C.

nickel 300 to 400° C.

steel 700 to 800° C.

cobalt 800 to 1000° C.

The "skin effect" is another parameter affecting the heating rates of the various components. The skin effect increases the resistance of an electrical conductor by reducing the cross sectional area through which current can flow. Generally, the resistance of a conductor R is given by:

$$R = \frac{l}{\sigma A}$$

where σ is the conductivity of the conductor material, l is the conductor length and A is a cross sectional area of the current path in the conductor. The depth of penetration δ is:

$$\delta \approx \frac{1}{\sqrt{\pi f \mu \mu_0 \sigma}}$$

where $\mu$ is the permeability of the conductor material, $\mu_0$ is the permeability of a vacuum, f is the frequency in Hz and $\sigma$ is the material conductivity. The depth of penetration of current flow decreases as the frequency increases and/or permeability increases. The majority of the current (approximately 63%) flows within the depth of penetration and almost all current (approximately 95%) flows within 3 $\sigma$.

The skin effect occurs in both the coil, as well as the flux concentrator and sheath (where eddy currents are inductively generated). In applications where the material itself is inductively heated, the skin effect may also affect the inductive heating rate of the material. Thus, both the Curie temperature and skin effect will affect the relative rates of heating of the assembly components and the material.

Returning to FIG. 5, the heating process is initiated by applying a source voltage potential across the coil causing increasing current to flow through the coil. The flow of current in the coil generates a magnetic field around the coil, proportional to the current through the coil. As the magnetic field grows it intersects the surrounding materials, namely the dielectric, the flux concentrator, the sheath and the material.

Because the sheath and flux concentrator are ferromagnetic, the magnetic field flows freely through these materials, causing eddy currents to flow therein. The eddy currents flow in a circumferential direction, opposing the direction of the eddy current in an adjacent coil turn. Because the flux concentrator has an open current loop, the net current through any path is relatively low. However, the current path in the sheath is closed circumferentially and eddy currents flow freely therein, inductively heating the sheath. The eddy currents in the sheath encounter resistance to flow depending on the cross sectional area of the flow path and the material properties as previously described.

The current in the coil also encounters resistance and creates heat. When the temperature of the coil is below its Curie point, the effective cross section is very small and constrained (due to the skin effect) to an outer circumferential area of the coil. However, when the coil reaches its Curie point the skin effect is greatly reduced and the cross sectional area in which current flows is correspondingly increased, thus reducing the resistance and the rate of heat generated in the coil. Thus, prior to reaching its Curie point, the coil heats at a faster rate.

The temperature of the material is completely dependent upon thermal conduction of heat from the sheath. Therefore, the temperature of the material always lags the sheath during heat up and is slightly cooler in steady state.

The temperature of the flux concentrator, assuming eddy currents are minimized, is substantially dependent on the conduction of heat from the coil to the flux concentrator. Because the flux concentrator is completely surrounded by the coil in the present embodiment, it will be warmer than the coil in steady state operation, if we assume that some heat generated in the coil is being transferred outwardly to the sheath and material. It is preferable to keep the temperature of the flux concentrator below its Curie point to maximize the inductive coupling of the coil and sheath. If the flux concentrator does reach its Curie point it will essentially open the magnetic loop around the coil and decrease the eddy current in the sheath substantially, thus reducing the temperature of the sheath and the material. However, this effect may be useful in certain temperature cycling processes in order to reduce the rate of heating of the material.

These and other modifications will be readily apparent to the skilled person as included within the scope of the following claims.

The invention claimed is:

1. A method of temperature cycling a flowable material traveling through a channel to modify the state of the material between flowable and nonflowable states, the method comprising:

providing an internal inductive heating assembly in the flowable material traveling through the channel;

the heating assembly comprising an exterior sheath disposed in contact with the material and an interior coil inductively coupled to the sheath;

supplying a signal to the coil to generate a magnetic flux in at least one of the sheath and the material, the magnetic flux generating inductive heating of the sheath and/or the material; and adjusting the signal to produce a desired rate of temperature cycling of the material in the channel which includes modifying the state of the material between flowable and nonflowable states.

2. The method of claim 1, wherein the nonflowable state is one or more of a physically rigid and a semi-rigid state.

3. The method of claim 1, wherein the flowable state is one or more of a semi-solid and a liquid state.

4. The method of claim 1, wherein:

the signal is supplied to the coil to generate the magnetic flux in both of the sheath and the material.

5. The method of claim 1, wherein:

the heating assembly further includes a flux concentrator to increase the inductive coupling between the coil and the sheath.

6. The method of claim 1, wherein the material is one or more of a metal and a polymer.

7. The method of claim 1, wherein the coil and sheath are configured to minimize heating of the coil in order to maintain the coil temperature within an operating limit.

8. The method of claim 1, wherein:

the signal comprises current pulses providing high frequency harmonics in the coil.

9. The method of claim 1, including:

selecting the Curie temperature(s) of one or more of the coil and sheath to provide a desired rate of inductive heating of the sheath and/or the material.

10. The method of claim 5, including:

selecting the Curie temperature(s) of one or more of the coil, sheath and flux concentrator to provide a desired rate of inductive heating of the sheath and/or the material.

11. The method of claim 1, including:

providing a coil material which is electrically conductive and paramagnetic at the coil operating temperature.

12. The method of claim 1, including:

providing a sheath material that is electrically conductive, thermally conductive, and ferromagnetic at the sheath operating temperature.

13. The method of claim 1, wherein:

the coil and sheath are in thermal communication to allow transmission of heat from the coil to the sheath.

14. The method of claim 5, including:

providing a flux concentrator material that is below its Curie point at the flux concentrator operating temperature.

15. The method of claim 13, including:

providing a dielectric material between the coil and sheath that is electrically insulating, thermally conductive and paramagnetic at the dielectric material operating temperature.

16. The method of claim 1, wherein:

the channel is provided in an outer element; and the temperature cycling includes cooling of the material by conductive transfer of heat from the material to the outer element.

17. The method of claim 1, wherein the material is one or more of an electrically conductive, ferromagnetic, electrically nonconductive, thermally insulating, and thermally conductive material.

18. The method of claim 1, wherein:

the channel is provided in a melt distribution system.

19. The method of claim 18, wherein:

the channel feeds a gate.

20. The method of claim 18, wherein:

the melt distribution system includes multiple channels feeding multiple gates and the temperature cycling is performed in parallel for the multiple gates.

* * * * *